US011305794B2

(12) United States Patent
Fang et al.

(10) Patent No.: US 11,305,794 B2
(45) Date of Patent: Apr. 19, 2022

(54) INTERLOCKING PROTECTION DEVICE FOR TURNOUT SWITCHING AND TURNOUT SYSTEM

(71) Applicant: BYD COMPANY LIMITED, Shenzhen (CN)

(72) Inventors: Yue Fang, Shenzhen (CN); Hongtao Wang, Shenzhen (CN); Jianbo Wu, Shenzhen (CN); Yun Chen, Shenzhen (CN); Peng He, Shenzhen (CN); Xianhua Liu, Shenzhen (CN)

(73) Assignee: BYD COMPANY LIMITED, Shenzhen (CN)

( * ) Notice: Subject to any disclaimer, the term of this patent is extended or adjusted under 35 U.S.C. 154(b) by 412 days.

(21) Appl. No.: 16/474,904

(22) PCT Filed: Dec. 26, 2017

(86) PCT No.: PCT/CN2017/118514
§ 371 (c)(1),
(2) Date: Jun. 28, 2019

(87) PCT Pub. No.: WO2018/121503
PCT Pub. Date: Jul. 5, 2018

(65) Prior Publication Data

US 2019/0329805 A1 Oct. 31, 2019

(30) Foreign Application Priority Data

Dec. 30, 2016 (CN) ..... 201611259531.8

(51) Int. Cl.
*B61L 21/08* (2006.01)
*B61L 5/10* (2006.01)
(Continued)

(52) U.S. Cl.
CPC ..... *B61L 21/08* (2013.01); *B61L 5/10* (2013.01); *B61L 19/06* (2013.01); *B61L 19/14* (2013.01); *B61L 2019/065* (2013.01)

(58) Field of Classification Search
CPC ..... B61L 19/00; B61L 19/06; B61L 19/14; B61L 21/04; B61L 21/08; B61L 5/10; B61L 2019/065; B61L 1/20
(Continued)

(56) References Cited

U.S. PATENT DOCUMENTS 4,181,278 A 1/1980 Pascoe
6,308,117 B1 * 10/2001 Ryland ..... B61L 19/06 246/131
2017/0001652 A1 * 1/2017 Lane ..... B61L 19/08

FOREIGN PATENT DOCUMENTS

CN 101537846 A 9/2009
CN 201329879 Y 10/2009
(Continued)

OTHER PUBLICATIONS

The World Intellectual Property Organization (WIPO) International Search Report for PCT/CN2017/118514 dated Mar. 26, 2018 8 Pages.

*Primary Examiner* — Zachary L Kuhfuss
(74) *Attorney, Agent, or Firm* — Anova Law Group, PLLC

(57) ABSTRACT

The present disclosure discloses an interlocking protection device for turnout switching. The interlocking protection device for turnout switching comprises a receiving module, a confirmation module, a processing module, and a centralized control interlocking module, wherein the receiving module is configured to receive a turnout switching instruction; the confirmation module is configured to receive a confirmation instruction; the processing module is configured to determine a target turnout position according to the
(Continued)

turnout switching instruction and output a driving confirmation signal according to the confirmation instruction; and the centralized control interlocking module comprises a confirmation unit and a position switch unit. Under a centralized control mode, the confirmation unit carries out separate turnout locking according to the target turnout position and carries out locking confirmation according to the driving confirmation signal. After locking confirmation, the position switch unit closes target turnout position switches and opens the other turnout position switches.

14 Claims, 3 Drawing Sheets

(51) Int. Cl.
*B61L 19/14* (2006.01)
*B61L 19/06* (2006.01)

(58) Field of Classification Search
USPC ..... 246/5, 131, 134
See application file for complete search history.

(56) References Cited

FOREIGN PATENT DOCUMENTS

| | | | |
|---|---|---|---|
| CN | 101683858 | A | 3/2010 |
| CN | 101973288 | A | 2/2011 |
| CN | 201951495 | U | 8/2011 |
| CN | 102229343 | A | 11/2011 |
| CN | 102328673 | A | 1/2012 |
| CN | 202463843 | U | 10/2012 |
| CN | 103786750 | A | 5/2014 |
| CN | 105539526 | A | 5/2016 |
| JP | H10315976 | A | 12/1998 |

* cited by examiner

INTERLOCKING PROTECTION DEVICE FOR TURNOUT SWITCHING AND TURNOUT SYSTEM

CROSS-REFERENCE TO RELATED APPLICATIONS

This application is a national phase entry under 35 U.S.C. § 371 of International Application No. PCT/CN2017/118514, filed on Dec. 26, 2017, which claims priority to China Patent Application No. 2016112595318, filed on Dec. 30, 2016, content of all of which is incorporated herein by reference in its entirety.

FIELD

The present disclosure belongs to the technical field of railway vehicles and, particularly relates to an interlocking protection device for turnout switching and a turnout system comprising same.

BACKGROUND

With the development of technology and an increase in population mobility, there are more and more vehicles and trains, and rail transit is more frequent. As line connection equipment enabling vehicles to be switched safely and smoothly into the other railway at the intersection of two railway lines, the turnout is used a lot in stations where lines intersect frequently. The safe switching of turnouts is the premise of ensuring the smooth passage of trains, for example, interlocking protection for turnout switching has been proposed in the related art, specifically, for example, comprising computer interlocking and relay type electric centralized interlocking, but the situation that a signal system transmits a switching signal again when a turnout is switched may still occur, causing switching failure.

SUMMARY

An objective of the present disclosure is to at least resolve one of the technical problems in the related art to some extent.

For this purpose, the present disclosure needs to propose an interlocking protection device for turnout switching, and the interlocking protection device for turnout switching can prevent a false switching signal from being received again during turnout switching, effectively decreasing risk.

The present disclosure further provides a turnout system comprising the interlocking protection device for turnout switching.

The interlocking protection device for turnout switching in one aspect of the present disclosure comprises: a receiving module, configured to receive a turnout switching instruction; a confirmation module, configured to receive a confirmation instruction; a processing module, configured to determine a target turnout position according to the turnout switching instruction and output a driving confirmation signal according to the confirmation instruction; and a centralized control interlocking module. The centralized control interlocking module comprises a confirmation unit and a position switch unit. Under a centralized control mode, the confirmation unit carries out separate turnout locking according to the target turnout position and carries out locking confirmation according to the driving confirmation signal. After locking confirmation, the position switch unit closes target turnout position switches according to the target turnout position and opens the other turnout position switches (except the target turnout position switches) to output a target turnout switching control signal.

As the interlocking protection device for turnout switching in embodiments of the present disclosure is added with the confirmation module and the confirmation unit, locking confirmation can be carried out before switching is performed, the switching of turnouts can be controlled more safely and reliably, the processing module can be prevented from transmitting a false switching signal again during turnout switching, and interlocking protection is carried out by the position switch unit, and thereby risk is decreased effectively.

Based on the interlocking protection device for turnout switching in the above aspect, the turnout system proposed by another aspect of the present disclosure comprises a turnout, a switcher and the interlocking protection device for turnout switching in the above aspect.

As the turnout system of the embodiments of the present disclosure adopts the interlocking protection device for turnout switching in the embodiments of the above aspect, turnout switching is safer and more reliable.

DETAILED DESCRIPTION

The following describes in detail embodiments of the present disclosure. Examples of the embodiments are shown in the accompanying drawings, where reference signs that are the same or similar from beginning to end represent same or similar components or components that have same or similar functions. The following embodiments described with reference to the accompanying drawings are exemplary, and are intended to describe the present disclosure and cannot be construed as a limitation to the present disclosure.

An interlocking protection device for turnout switching and a turnout system comprising same according to embodiments of the present disclosure will be described below with reference to the accompanying drawings.

Figure 1:
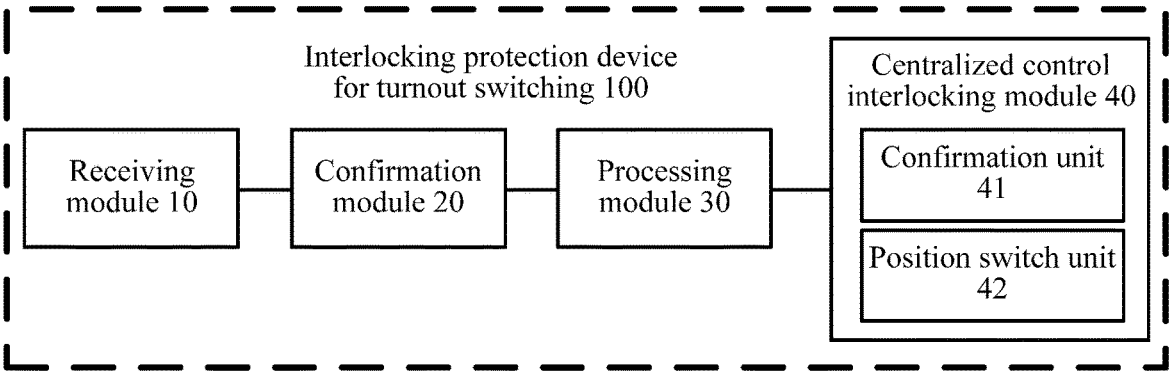
FIG. 1 is a block diagram of an interlocking protection device for turnout switching according to embodiments of the present disclosure.

FIG. 1 is a block diagram of the interlocking protection device for turnout switching according to the embodiments of the present disclosure. As shown in FIG. 1, the interlocking protection device for turnout switching 100 comprises a receiving module 10, a confirmation module 20, a processing module 30, and a centralized control interlocking module 40.

The receiving module 10, such as a switching start button, is configured to receive a turnout switching instruction, for example, during passage through the train route of one turnout, the receiving module 10 can be operated to select the turnout to transmit a turnout switching signal.

The confirmation module 20 is configured to receive a confirmation instruction, i.e. an instruction for allowing turnout beam locking. It should be explained that without limitation, the specific forms of the receiving module 10 and the confirmation module 20 can be separately arranged buttons, or two operations of a button or other forms that can be implemented.

The processing module 30, such as a signal system in the prior art, determines a target turnout position according to the turnout switching instruction, and outputs a driving confirmation signal according to the confirmation instruction.

The centralized control interlocking module 40 comprises a confirmation unit 41 and a position switch unit 42. Under a centralized control mode, the confirmation unit 41 carries out separate turnout locking according to the target turnout position and carries out locking confirmation according to the driving confirmation signal. Specifically, during passage through the train route of one turnout, after the receiving operation and turnout switching signal transmission of the receiving module 10, the processing module 30 carries out calculation and selection; if it is determined that the turnout is idle and does not go wrong, the confirmation unit 41 is controlled to act to separately lock a turnout beam of the turnout, that is, other equipment, such as an annunciator, a route locking signal or other turnout control signals, will not make a response, and thereby, after the confirmation module 20 outputs a confirmation instruction, the confirmation unit 41 is controlled to act to allow turnout locking, for example, allowing the position switch unit 42 to make a corresponding action to drive a target turnout to be switched, that is, confirmation is carried out again. By arranging the confirmation unit 41 in the centralized control interlocking module 40, dual confirmation is carried out to increase safety.

After locking confirmation, the position switch unit 42 closes target turnout position switches according to the target turnout position and opens the other turnout position switches (except the target turnout position switches) to output a target turnout switching control signal, realizing interlocking protection, and thereby, when the target turnout is switched, the other switching signals will be ineffective, effectively decreasing risk.

Figure 2:
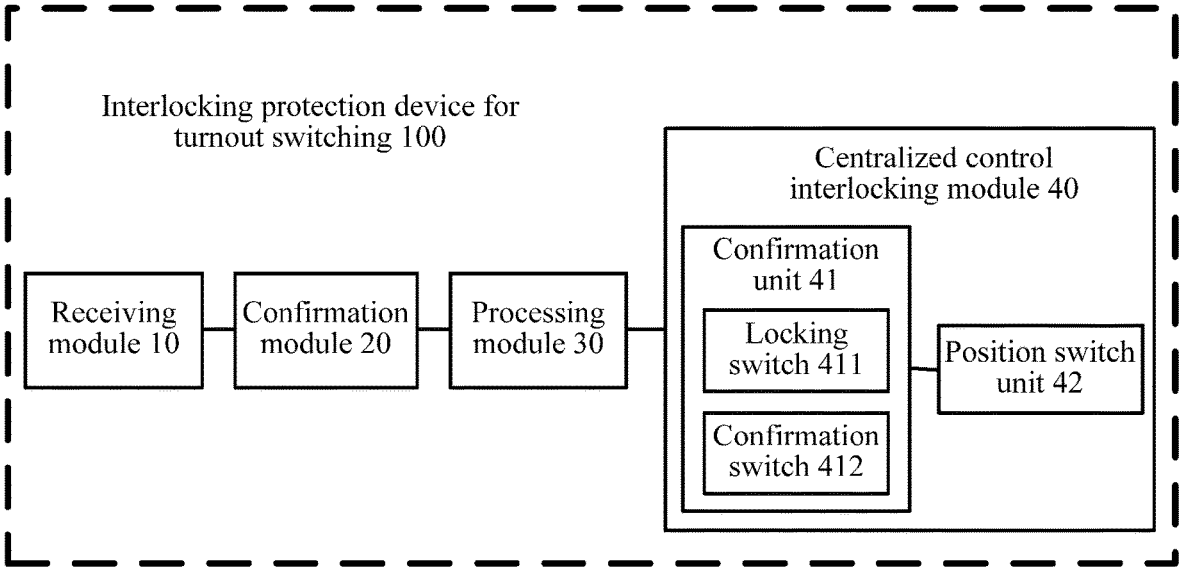
FIG. 2 is a block diagram of the interlocking protection device for turnout switching according to an embodiment of the present disclosure.

Further, as shown in FIG. 2, the confirmation unit 41 comprises locking switches 411 and confirmation switches 412. The locking switches 411 are configured to be closed to carry out separate turnout locking when the target turnout position is received under the centralized control mode, that is, after the receiving module 10 receives a turnout switching signal output by a user's instruction, the processing module 30 carries out calculation and selection; if it is determined that the state of the target turnout position is suitable for train passage, the locking switches 411 are controlled to be closed to carry out the separate locking of the turnout, and the other control signals can be ignored. The confirmation switches 412 are configured to be closed to carry out locking confirmation when the driving confirmation signal is received under the centralized control mode, and specifically, after the confirmation module 20 receives the confirmation instruction of the user, the processing module 30 controls the confirmation switches 412 to act, which is equivalent to allowing turnout locking after reconfirmation. Dual safety protection is realized by the locking switches 411 and the confirmation switches 412, decreasing switching risk.

Figure 3:
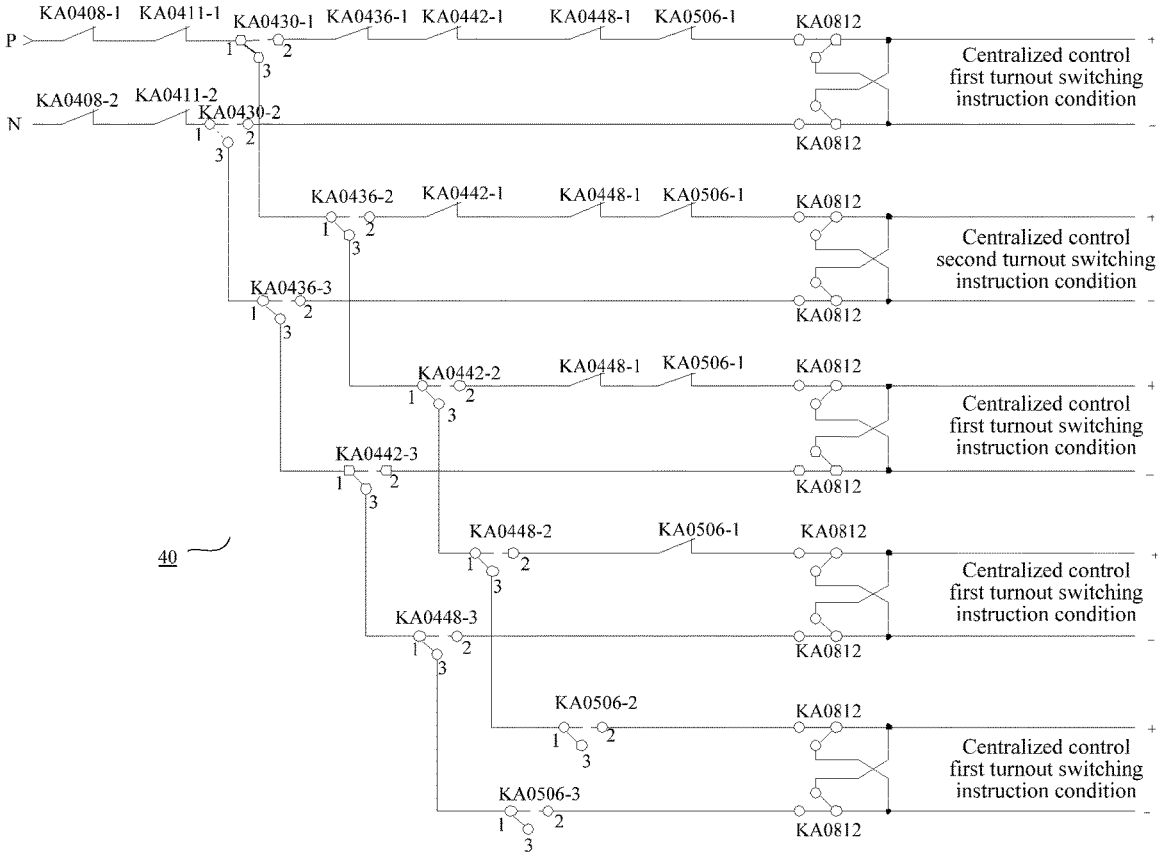
FIG. 3 is a schematic diagram of a centralized control interlocking module according to an embodiment of the present disclosure.

Referring to FIG. 3, there are two locking switches 411 and two confirmation switches 412. For example, the locking switches 411 comprise a first locking switch KA0408-1 and a second locking switch KA0408-2, and the confirmation switches 412 comprise a first confirmation switch KA0411-1 and a second confirmation switch KA0411-2. One end of the first locking switch (such as KA0408-1) is connected to one end of the first confirmation switch (such as KA0411-1), the other end of the first locking switch KA0408-1 is connected to a positive pole P of a power supply, the other end of the first confirmation switch KA0411-1 is connected to the position switch unit 42, one end of the second locking switch (such as KA0408-2) is connected to one end of the second confirmation switch (such as KA0411-2), the other end of the second locking switch KA0408-2 is connected to a negative pole N of the power supply, and the other end of the second confirmation switch KA0411-2 is connected to the position switch unit 42. The processing module 30 carries out calculation and selection according to the turnout switching instruction; if it is determined that the state of the target turnout position is suitable for train passage, then KA0408-1 and KA0408-2 are controlled to be closed to carry out the separate locking of the turnout; when the confirmation module 20 receives the confirmation instruction, the processing module 30 controls KA0411-1 and KA0411-2 to be closed to carry out locking confirmation, consequently, dual safety guarantee is realized, the other control signals will not be effective any more, and thereby safety is increased.

Further, in the embodiments of the present disclosure, the turnout may comprise a double-line form, a three-line form, a four-line form, a five-line form or even more forms, which can all realize interlocking protection without specific limitations herein.

Referring to FIG. 3, for the interlocking protection of two turnout lines, the position switch unit 42 may comprise a first interlocking protection branch and a second interlocking protection branch.

The first interlocking protection branch comprises normally opened first turnout position switches KA0430-1 and a normally closed second turnout position switch KA0436-1, there are two normally opened first turnout position switches, each normally opened first turnout position switch comprises a movable contact 1, a first stationary contact 2, and a second stationary contact 3, wherein the movable contact 1 of the normally opened first turnout position switch KA0430-1 is connected to the other end of the first conformation switch KA0411-1, the first stationary contact 2 of the normally opened first turnout position switch KA0430-1 is connected to one end of the normally closed second turnout position switch KA0436-1, and the other end of the normally closed second turnout position switch KA0436-1 is connected to a turnout switcher. The movable contact 1 of the other normally opened first turnout position switch KA0430-2 is connected to the other end of the second confirmation switch KA0411-2, and the first stationary contact 2 of the normally opened first turnout position switch KA0430-2 is connected to the turnout switcher.

The second interlocking protection branch comprises normally opened second turnout position switches, there are two normally opened second turnout position switches, wherein each normally opened second turnout position switch comprises a movable contact 1, a first stationary contact 2, and a second stationary contact 3, the movable contact 1 of the normally opened second turnout position switch KA0436-2 is connected to the second stationary contact 3 of the normally opened first turnout position switch KA0430-1, the first stationary contact 2 of the normally opened second turnout position switch KA0436-2 is connected to the turnout switcher, the movable contact 1 of the other normally opened second turnout position switch KA0436-3 is connected to the second stationary contact 3 of the other normally opened first turnout position switch KA0430-2, and the first stationary contact 2 of the normally opened second turnout position switch KA0436-3 is connected to the turnout switcher.

When switching control is carried out, if the target turnout position is a first turnout position, the normally opened first turnout position switches KA0430-1 and KA0430-2 are controlled to be electrified while the other turnout position switches are kept under the power-off state, so that the circuit of the first interlocking protection branch is closed, outputting a centralized first turnout switching control instruction condition to the turnout switcher to carry out the switching control of the first turnout position, while a second turnout position is under an ineffective state. If the target turnout position is the second turnout position, the normally opened second turnout position switches KA0436-2 and KA0436-3 are controlled to be electrified while the other turnout position switches are kept under the current power-off state, so that the circuit of the second interlocking protection branch is closed at this moment, outputting a centralized second turnout switching control instruction condition to the turnout switcher to carry out the switching control of the second turnout position, while first turnout position control is ineffective, and thereby interlocking protection is realized.

Referring to FIG. 3, for a three-line turnout, on the basis of the two turnout lines, the first interlocking protection branch and the second interlocking protection branch respectively further comprise a normally closed third turnout position switch KA0442-1, wherein, in the first interlocking protection branch, one end of the normally closed third turnout position switch KA0442-1 is connected to the other end of the normally closed second turnout position switch KA0436-1, and the other end of the normally closed third turnout position switch KA0442-1 is connected to the turnout switcher; in the second interlocking protection branch, one end of the normally closed third turnout position switch KA0442-1 is connected to the first stationary contact 2 of the normally opened second turnout position switch KA0436-2, and the other end of the normally closed third turnout position switch KA0442-1 is connected to the turnout switcher.

The position switch unit 42 further comprises a third interlocking protection branch, the third interlocking protection branch comprises normally opened third turnout position switches, there are two normally opened third turnout position switches, each normally opened third turnout position switch comprises a movable contact 1, a first stationary contact 2, and a second stationary contact 3, the movable contact 1 of the normally opened third turnout position switch KA0442-2 is connected to the second stationary contact 3 of the normally opened second turnout position switch KA0436-2, the first stationary contact 2 of the normally opened third turnout position switch KA0442-2 is connected to the turnout switcher, the movable contact 1 of the other normally opened third turnout position switch KA0442-3 is connected to the second stationary contact 3 of the other normally opened second turnout position switch KA0436-3, and the first stationary contact 2 of the normally opened third turnout position switch KA0442-3 is connected to the turnout switcher.

When switching control is carried out, if the target switching turnout position is a second turnout position, the normally opened third turnout position switches KA0442-2 and KA0442-3 are controlled to be electrified while the other turnout position switches are kept under the power-off state, so that the circuit of the third interlocking protection branch is closed, outputting a centralized third turnout switching control instruction condition to the turnout switcher to carry out the switching control of the third turnout position, while the other turnout position control signals are ineffective, and thereby the interlocking protection effect is achieved.

For a four-line turnout, on the basis of the above three-line turnout, the first interlocking protection branch, the second interlocking protection branch and the third interlocking protection branch respectively further comprise a normally closed fourth turnout position switch KA0448-1, wherein, in the first interlocking protection branch and the second interlocking protection branch, one end of the normally closed fourth turnout position switch KA0448-1 is connected to the other end of the normally closed third turnout position switch KA0442-1, and the other end of the normally closed fourth turnout position switch KA0448-1 is connected to the turnout switcher; in the third interlocking protection branch, one end of the normally closed fourth turnout position switch KA0448-1 is connected to the first stationary contact 2 of the normally opened third turnout position switch KA0442-2, and the other end of the normally closed fourth turnout position switch KA0448-1 is connected to the turnout switcher.

The position switch unit 42 further comprises a fourth interlocking protection branch, the fourth interlocking protection branch comprises normally opened fourth turnout position switches, there are two normally opened fourth turnout position switches, each normally opened fourth turnout position switch comprises a movable contact 1, a first stationary contact 2, and a second stationary contact 3, the movable contact 1 of the normally opened fourth turnout position switch KA0448-2 is connected to the second stationary contact 3 of the normally opened third turnout position switch KA0442-2, the first stationary contact 2 of the normally opened fourth turnout position switch KA0448-2 is connected to the turnout switcher, the movable contact 1 of the other normally opened fourth turnout position switch KA0448-3 is connected to the second stationary contact 3 of the other normally opened third turnout position switch KA0442-3, and the first stationary contact 2 of the other normally opened fourth turnout position switch KA0448-3 is connected to the turnout switcher.

When switching control is carried out, if the target turnout position is a fourth turnout position, the normally opened fourth turnout position switches KA0448-2 and KA0448-3 are controlled to be electrified while the other turnout position switches are kept under the power-off state, so that the circuit of the fourth interlocking protection branch is closed, outputting a centralized fourth turnout switching control instruction condition to the turnout switcher to carry out the switching control of the fourth turnout position, while the other turnout position control signals are ineffective, and thereby the interlocking protection effect is achieved.

Referring to FIG. 3, for a five-line turnout, on the basis of the above four-line turnout, the first interlocking protection branch, the second interlocking protection branch, the third interlocking protection branch and the fourth interlocking protection branch respectively further comprise a normally closed fifth turnout position switch KA0506-1, wherein, in the first interlocking protection branch, the second interlocking protection branch and the third interlocking protection branch, one end of the normally closed fifth turnout position switch KA0506-1 is connected to the other end of the normally closed fourth turnout position switch KA0448-1, and the other end of the normally closed fifth turnout position switch KA0506-1 is connected to the turnout switcher; in the fourth interlocking protection branch, one end of the normally closed fifth turnout position switch KA0506-1 is connected to the first stationary contact 2 of the normally opened fourth turnout position switch KA0448-2, and the other end of the normally closed fifth turnout position switch KA0506-1 is connected to the turnout switcher.

The position switch unit 42 further comprises a fifth interlocking protection branch, the fifth interlocking protection branch comprises normally opened fifth turnout position switches, there are two normally opened fifth turnout position switches, each normally opened fifth turnout position switch comprises a movable contact 1, a first stationary contact 2, and a second stationary contact 3, wherein the movable contact of the normally opened fifth turnout position switch KA0506-2 is connected to the second stationary contact 3 of the normally opened fourth turnout position switch KA0448-2, the first stationary contact 2 of the normally opened fifth turnout position switch KA0506-2 is connected to the turnout switcher, the movable contact 1 of the other normally opened fifth turnout position switch KA0506-3 is connected to the second stationary contact 3 of the other normally opened fourth turnout position switch KA0448-3, and the first stationary contact 2 of the other normally opened fifth turnout position switch KA0506-3 is connected to the turnout switcher.

When switching control is carried out, if the target turnout position is a fifth turnout position, the normally opened fifth turnout position switches KA0506-2 and KA0506-3 are controlled to be electrified while the other turnout position switches are kept under the power-off state, so that the circuit of the fifth interlocking protection branch is closed, outputting a centralized fifth turnout switching control instruction condition to the turnout switcher to carry out the switching control of the fifth turnout position, while the other turnout position control signals are ineffective, and thereby the interlocking protection effect is achieved.

In addition, in FIG. 3, each interlocking protection branch further comprises a zone locking relay KA0812, which is configured to carry out zone locking control.

Specifically, referring to FIG. 3, during passage through the train route of the first turnout, after a first turnout switching signal is transmitted, by the calculation and selection of the processing module 30 (i.e. an interlocking computer of the signal system), the normally opened first turnout position switches KA0430-1 and KA0430-2 are controlled to be electrified, meanwhile, the other turnout position switches are power-off, and thereby interlocking protection is formed. Under normal conditions, the normally opened turnout position switches of only one of the five interlocking protection branches can have output, the confirmation switches KA0411 act, and after the separate turnout locking condition is checked, a turnout switching condition is output to the outdoor turnout system. Each of the above switches can be implemented by adopting a relay form, for example, the process of action in the interlocking protection for the first turnout position is: power supply→electrifying the locking relays KA0408→electrifying the confirmation switches (i.e. turnout locking-allowing relays) KA0411→electrifying the normally opened first turnout position switches (i.e. turnout position indication relays) KA0430→keeping the position switches for the other turnout positions under the power-off state (i.e. cutting off the power of the turnout position indication relays KA0436/KA0442/KA0448/KA0506)→outputting a turnout switching condition (i.e. transmitting a first turnout position switching control signal to the turnout switcher to switch the first turnout position), realizing track change for a train.

Figure 4:
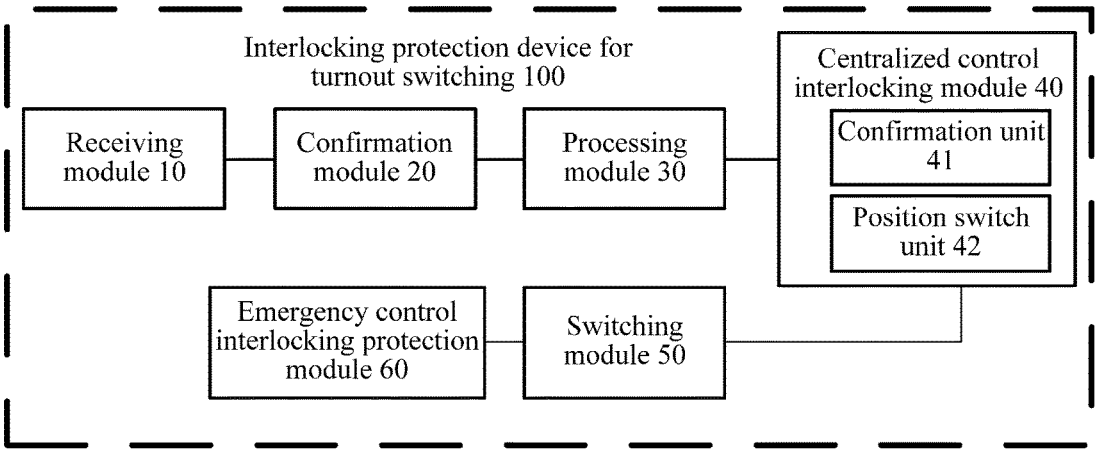
FIG. 4 is a block diagram of the interlocking protection device for turnout switching according to another embodiment of the present disclosure.

As shown in FIG. 4, the interlocking protection device for turnout switching 100 in the embodiments of the present disclosure further comprises a switching module 50, such as a turnout position change-over switch, the switching module 50 is configured to receive a switching instruction to switch to an emergency control mode and determine a target turnout position to carry out switching control under emergency.

As shown in FIG. 4, the interlocking protection device for turnout switching 100 further comprises an emergency control interlocking protection module 60, and under the emergency control mode, the emergency control interlocking protection module 60 is configured to control the target turnout position switches to be electrified according to a target turnout position and keep the other turnout position switches (except the target turnout position switches) power-off to output a target turnout switching control signal.

Figure 5:
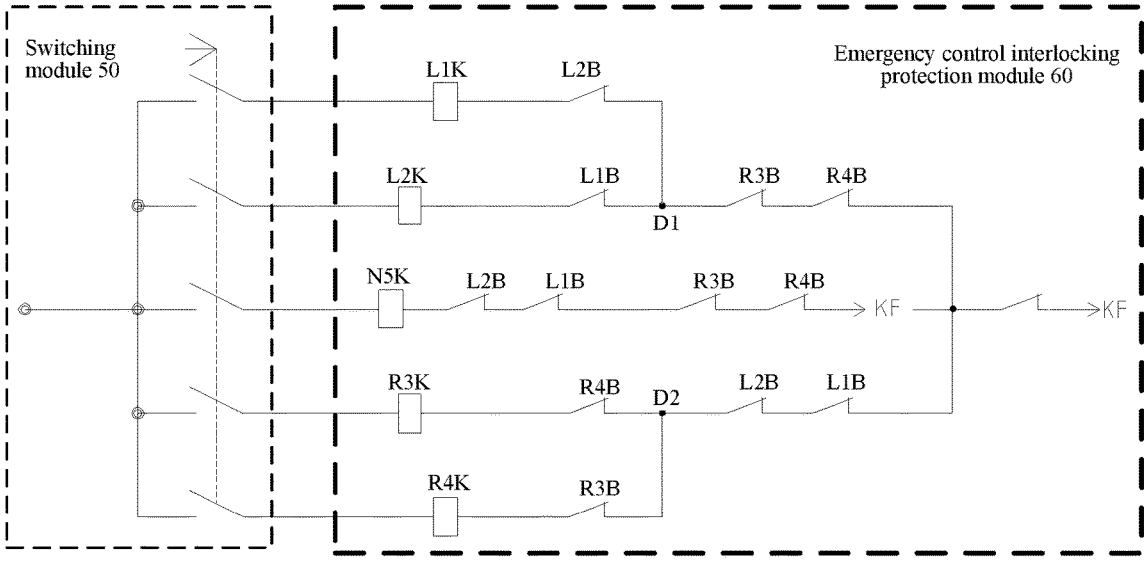
FIG. 5 is a schematic diagram of an emergency control interlocking module according to an embodiment of the present disclosure.

Specifically, FIG. 5 shows a schematic circuit diagram of emergency control interlocking protection for a five-line turnout according to an embodiment of the present disclosure, and the emergency control interlocking protection module 60 comprises a first emergency interlocking protection branch, a second emergency interlocking protection branch, a third emergency interlocking protection branch, a fourth emergency interlocking protection branch, and a fifth emergency interlocking protection branch. It can be understood that emergency interlocking protection branches can be arranged according to the actual condition of lines.

The first emergency interlocking protection branch comprises a normally opened first turnout position relay L1K and a normally closed second turnout position relay L2B, one end of the normally opened first turnout position relay L1K is connected to the switching module 50, and the other end of the normally opened first turnout position relay L1K is connected to one end of the normally closed second turnout position relay L2B.

The second emergency interlocking protection branch comprises a normally opened second turnout position relay L2K, a normally closed first turnout position relay L1B, a normally closed third turnout position relay R3B, and a normally closed fourth turnout position relay R4B, one end of the normally opened second turnout position relay L2K is connected to the switching module 50, the other end of the normally opened second turnout position relay L2K is connected to one end of the normally closed first turnout position relay LIB, the other end of the normally closed first turnout position relay L1B is connected to one end of the normally closed third turnout position relay R3B, a first node D1 is arranged between the other end of the normally closed first turnout position relay L1B and one end of the normally closed third turnout position relay R3B, the first node D1 is connected to the other end of the normally closed second turnout position relay L2B in the first emergency interlocking protection branch, the other end of the normally closed third turnout position relay R3B is connected to one end of the normally closed fourth turnout position relay R4B, and the other end of the normally closed fourth turnout position relay R4B is connected to the turnout switcher.

The third emergency interlocking protection branch comprises a normally opened third turnout position relay R3K, a normally closed fourth turnout position relay R4B, a normally closed second turnout position relay L2B, and the normally closed first turnout position relay L1B, one end of the normally opened third turnout position relay R3K is connected to the switching module 50, the other end of the normally opened third turnout position relay R3K is connected to one end of the normally closed fourth turnout position relay R4B, the other end of the normally closed fourth turnout position relay R4B is connected to one end of the normally closed second turnout position relay L2B, a second node D2 is arranged between the other end of the normally closed fourth turnout position relay R4B and one end of the normally closed second turnout position relay L2B, the other end of the normally closed second turnout position relay L2B is connected to one end of the normally closed first turnout position relay L1B, and the other end of the normally closed first turnout position relay L1B is connected to the turnout switcher.

The fourth emergency interlocking protection branch comprises a normally opened fourth turnout position relay R4K and a normally closed third turnout position relay R3B, one end of the normally opened fourth turnout position relay R4K is connected to the switching module 50, the other end of the normally opened fourth turnout position relay R4K is connected to one end of the normally closed third turnout position relay R3B, and the other end of the normally closed third turnout position relay R3B is connected to the second node D2.

The fifth emergency interlocking protection branch comprises a normally opened fifth turnout position relay N5K, a normally closed second turnout position relay L2B, a normally closed first turnout position relay L1B, a normally closed third turnout position relay R3B, and a normally closed fourth turnout position relay R4B, wherein one end of the normally opened fifth turnout position relay N5K is connected to the switching module 50, the other end of the normally opened fifth turnout position relay N5K is connected to one end of the normally closed second turnout position relay L2B, the other end of the normally closed second turnout position relay L2B is connected to one end of the normally closed first turnout position relay L1B, the other end of the normally closed first turnout position relay L1B is connected to one end of the normally closed third turnout position relay R3B, the other end of the normally closed third turnout position relay R3B is connected to one end of the normally closed fourth turnout position relay R4B, the other end of the normally closed fourth turnout position relay R4B is connected to the turnout switcher, wherein KF represents a fuse.

For example, when the switching module 50 switches to the emergency control mode, a to-be-switched turnout position, i.e. a target turnout position, is selected, for example, the first turnout position is selected, at this moment, the normally opened first turnout position relay L1K is electrified, outputting a switching condition, meanwhile, the normally opened relays of the other turnout positions are kept power-off, consequently, while the first emergency interlocking protection branch is controlled to be closed, the effectiveness of the control signals of the other emergency interlocking protection branches is forbidden, an interlocking protection mechanism under the emergency mode is realized, and the other switching signals are prevented from being received to cause system disorder and errors when the first turnout is switched.

In general, as the interlocking protection device for turnout switching 100 in embodiments of the present disclosure is added with the confirmation module 20 and the confirmation unit 41, locking confirmation can be carried out before switching is performed, the switching of turnouts can be controlled more safely and reliably, the processing module 30 can be prevented from transmitting a false switching signal again during turnout switching, and interlocking protection is carried out by the position switch unit 42, and thereby turnout switching risk is decreased effectively.

Figure 6:
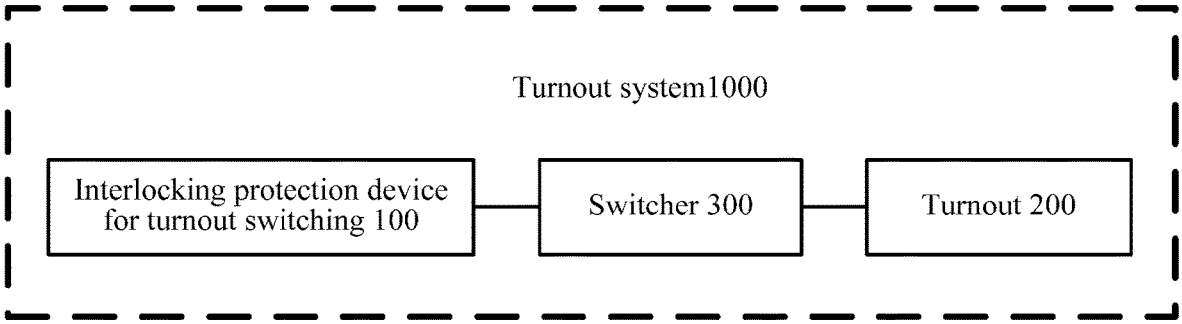
FIG. 6 is a block diagram of a turnout system according to embodiments of the present disclosure.

Based on the interlocking protection device for turnout switching in the embodiments of the above aspect, the turnout system of the embodiments of the other aspect of the present disclosure is shown as FIG. 6, and the turnout system 1000 comprises the interlocking protection device for turnout switching 100 in the above embodiments, a turnout 200, and a switcher 300. The switcher 300 drives switching according to a switching condition output by the interlocking protection device for turnout switching 100, realizing the switching control of the target turnout, and it is safer and more reliable.

As the turnout system 1000 of the embodiments of the present disclosure adopts the interlocking protection device for turnout switching 100 in the embodiments of the above aspect, turnout switching is safer and more reliable.

It should be noted that in the descriptions of this specification, a description of a reference term such as "an embodiment", "some embodiments", "an example", "a specific example", or "some examples" means that a specific feature, structure, material, or characteristic that is described with reference to the embodiment or the example is included in at least an embodiment or example of the present disclosure. In this specification, exemplary descriptions of the foregoing terms do not necessarily refer to a same embodiment or example. In addition, the described specific features, structures, materials, or characteristics may be combined in a proper manner in any one or more of the embodiments or examples. In addition, a person skilled in the art may integrate or combine different embodiments or examples and characteristics of different embodiments or examples described in the specification, as long as they do not conflict each other.

Although the embodiments of the present disclosure are shown and described above, it can be understood that, the foregoing embodiments are exemplary, and cannot be construed as a limitation to the present disclosure. Within the scope of the present disclosure, a person of ordinary skill in the art may make changes, modifications, replacement, and variations to the foregoing embodiments.

What is claimed is:

1. An interlocking protection device for turnout switching, comprising:

a receiving module, configured to receive a turnout switching instruction;

a confirmation module, configured to receive a confirmation instruction;

a processing module, configured to determine a target turnout position according to the turnout switching instruction and output a driving confirmation signal according to the confirmation instruction; and a centralized control interlocking module, wherein the centralized control interlocking module comprises a confirmation unit and a position switch unit; under a centralized control mode, the confirmation unit carries out separate turnout locking according to the target turnout position and carries out locking confirmation according to the driving confirmation signal; after locking confirmation, the position switch unit closes target turnout position switches according to the target turnout position and opens other turnout position switches to output a target turnout switching control signal, wherein the confirmation unit further comprises:

locking switches, configured to be closed to carry out separate turnout locking when the target turnout position is received under the centralized control mode; and confirmation switches, configured to be closed to carry out locking confirmation when the driving confirmation signal is received under the centralized control mode.

2. The interlocking protection device for turnout switching according to claim 1, herein the locking switches comprise a first locking switch and a second locking switch, and the confirmation switches comprise a first confirmation switch and a second confirmation switch.

3. The interlocking protection device for turnout switching according to claim 2, wherein, one end of the first locking switch is connected to one end of the first confirmation switch, the other end of the first locking switch is connected to a positive pole of a power supply, the other end of the first confirmation switch is connected to the position switch unit, one end of the second locking switch is connected to one end of the second confirmation switch, the other end of the second locking switch is connected to a negative pole of the power supply, and the other end of the second confirmation switch is connected to the position switch unit.

4. The interlocking protection device for turnout switching according to claim 3, wherein the position switch unit comprises:

a first interlocking protection branch, wherein the first interlocking protection branch comprises normally opened first turnout position switches and a normally closed second turnout position switch, there are two normally opened first turnout position switches, each normally opened first turnout position switch comprises a movable contact, a first stationary contact, and a second stationary contact, wherein the movable contact of the normally opened first turnout position switch is connected to the other end of the first conformation switch, the first stationary contact of the normally opened first turnout position switch is connected to one end of the normally closed second turnout position switch, the other end of the normally closed second turnout position switch is connected to a turnout switcher, the movable contact of the other normally opened first turnout position switch is connected to the other end of the second confirmation switch, and the first stationary contact of the normally opened first turnout position switch is connected to the turnout switcher; and a second interlocking protection branch, wherein the second interlocking protection branch comprises normally opened second turnout position switches, there are two normally opened second turnout position switches, wherein each normally opened second turnout position switch comprises a movable contact, a first stationary contact, and a second stationary contact, the movable contact of the normally opened second turnout position switch is connected to the second stationary contact of the normally opened first turnout position switch, the first stationary contact of the normally opened second turnout position switch is connected to the turnout switcher, the movable contact of the other normally opened second turnout position switch is connected to the second stationary contact of the other normally opened first turnout position switch, and the first stationary contact of the other normally opened second turnout position switch is connected to the turnout switcher.

5. The interlocking protection device for turnout switching according to claim 4, wherein the first interlocking protection branch and the second interlocking protection branch respectively further comprise a normally closed third turnout position switch, wherein, in the first interlocking protection branch, one end of the normally closed third turnout position switch is connected to the other end of the normally closed second turnout position switch, and the other end of the normally closed third turnout position switch is connected to the turnout switcher; in the second interlocking protection branch, one end of the normally closed third turnout position switch is connected to the first stationary contact of the normally opened second turnout position switch, and the other end of the normally closed third turnout position switch is connected to the turnout switcher; and the position switch unit further comprises a third interlocking protection branch, the third interlocking protection branch comprises normally opened third turnout position switches, there are two normally opened third turnout position switches, each normally opened third turnout position switch comprises a movable contact, a first stationary contact, and a second stationary contact, the movable contact of the normally opened third turnout position switch is connected to the second stationary contact of the normally opened second turnout position switch, the first stationary contact of the normally opened third turnout position switch is connected to the turnout switcher, the movable contact of the other normally opened third turnout position switch is connected to the second stationary contact of the other normally opened second turnout position switch, and the first stationary contact of the other normally opened third turnout position switch is connected to the turnout switcher.

6. The interlocking protection device for turnout switching according to claim 5, wherein the first interlocking protection branch, the second interlocking protection branch and the third interlocking protection branch respectively further comprise a normally closed fourth turnout position switch, wherein, in the first interlocking protection branch and the second interlocking protection branch, one end of the normally closed fourth turnout position switch is connected to the other end of the normally closed third turnout position switch, and the other end of the normally closed fourth turnout position switch is connected to the turnout switcher; in the third interlocking protection branch, one end of the normally closed fourth turnout position switch is connected to the first stationary contact of the normally opened third turnout position switch, and the other end of the normally closed fourth turnout position switch is connected to the turnout switcher; and the position switch unit further comprises a fourth interlocking protection branch, the fourth interlocking protection branch comprises normally opened fourth turnout position switches, there are two normally opened fourth turnout position switches, each normally opened fourth turnout position switch comprises a movable contact, a first stationary contact, and a second stationary contact, the movable contact of the normally opened fourth turnout position switch is connected to the second stationary contact of the normally opened third turnout position switch, the first stationary contact of the normally opened fourth turnout position switch is connected to the turnout switcher, the movable contact of the other normally opened fourth turnout position switch is connected to the second stationary contact of the other normally opened third turnout position switch, and the first stationary contact of the other normally opened fourth turnout position switch is connected to the turnout switcher.

7. The interlocking protection device for turnout switching according to claim 6, wherein the first interlocking protection branch, the second interlocking protection branch, the third interlocking protection branch and the fourth interlocking protection branch respectively further comprise a normally closed fifth turnout position switch, wherein, in the first interlocking protection branch, the second interlocking protection branch and the third interlocking protection branch, one end of the normally closed fifth turnout position switch is connected to the other end of the normally closed fourth turnout position switch, and the other end of the normally closed filth turnout position switch is connected to the turnout switcher; in the fourth interlocking protection branch, one end of the normally closed fifth turnout position switch is connected to the first stationary contact of the normally opened fourth turnout position switch, and the other end of the normally closed fifth turnout position switch is connected to the turnout switcher; and the position switch unit further comprises a fifth interlocking protection branch, the fifth interlocking protection branch comprises normally opened fifth turnout position switches, there are two normally opened fifth turnout position switches, each normally opened fifth turnout position switch comprises a movable contact, a first stationary contact, and a second stationary contact, wherein the movable contact of the normally opened fifth turnout position switch is connected to the second stationary contact of the normally opened fourth turnout position switch, the first stationary contact of the normally opened fifth turnout position switch is connected to the turnout switcher, the movable contact of the other normally opened fifth turnout position switch is connected to the second stationary contact of the other normally opened fourth to turnout position switch, and the first stationary contact of the other normally opened fifth turnout position switch is connected to the turnout switcher.

8. The interlocking protection device for turnout switching according to claim 7, wherein each of the first interlocking protection branch, the second interlocking protection branch, the third interlocking protection branch, the fourth interlocking protection branch and the fifth interlocking protection branch comprises a zone locking relay.

9. The interlocking protection device for turnout switching according to claim 1, further comprising:

a switching module, configured to receive a switching; instruction to switch to an emergency control mode and determine the target turnout position.

10. The interlocking protection device for turnout switching according to claim 9, further comprising:

an emergency control interlocking protection module, configured to control the target turnout position switches to be electrified according to the target turnout position and keep the other turnout position switches power-off to output a target turnout switching control signal under the emergency control mode.

11. The interlocking protection device for turnout switching according to claim 10, wherein the emergency control interlocking protection module comprises:

a first emergency interlocking protection branch, the first emergency interlocking protection branch comprises a normally opened first turnout position relay and a normally closed second turnout position relay, one end of the normally opened first turnout position relay is connected to the switching module, and the other end of the normally opened first turnout position relay is connected to one end of the normally closed second turnout position relay;

a second emergency interlocking protection branch, the second emergency interlocking protection branch comprises a normally opened second turnout position relay, a normally closed first turnout position relay, a normally closed third turnout position relay, and a normally closed fourth turnout position relay, one end of the normally opened second turnout position relay is connected to the switching module, the other end of the normally opened second turnout position relay is connected to one end of the normally closed first turnout position relay, the other end of the normally closed first turnout position relay is connected to one end of the normally closed third turnout position relay, a first node is arranged between the other end of the normally closed first turnout position relay and one end of the normally closed third turnout position relay, the first node is connected to the other end of the normally closed second turnout position relay in the first emergency interlocking protection branch, the other end of the normally closed third turnout position relay is connected to one end of the normally closed fourth turnout position relay, and the other end of the normally closed fourth turnout position relay is connected to the turnout switcher;

a third emergency interlocking protection branch, the third emergency interlocking protection branch comprises a normally opened third turnout position relay, a normally closed fourth turnout position relay, a normally closed second turnout position relay, and the normally closed first turnout position relay, one end of the normally opened third turnout position relay is connected to the switching module, the other end of the normally opened third turnout position relay is connected to one end of the normally closed fourth turnout position relay, the other end of the normally closed fourth turnout position relay is connected to one end of the normally closed second turnout position relay, a second node is arranged between the other end of the normally closed fourth turnout position relay and one end of the normally closed second turnout position relay, the other end of the normally closed second turnout position relay is connected to one end of the normally closed first turnout position relay, and the other end of the normally closed first turnout position relay is connected to the turnout switcher; and a fourth emergency interlocking protection branch, the fourth emergency interlocking protection branch comprises a normally opened fourth turnout position relay and a normally closed third turnout position relay, one end of the normally opened fourth turnout position relay is connected to the switching module, the other end of the normally opened fourth turnout position relay is connected to one end of the normally closed third turnout position relay, and the other end of the normally closed third turnout position relay is connected to the second node; and a fifth emergency interlocking protection branch, the fifth emergency interlocking protection branch comprises a normally opened fifth turnout position relay, a normally closed second turnout position relay, a normally closed first turnout position relay, a normally closed third turnout position relay, and a normally closed fourth turnout position relay, wherein one end of the normally opened fifth turnout position relay is connected to the switching module, the other end of the normally opened fifth turnout position relay is connected to one end of the normally closed second turnout position relay, the other end of the normally closed second turnout position relay is connected to one end of the normally closed first turnout position relay, the other end of the normally closed first turnout position relay is connected to one end of the normally closed third turnout position relay, the other end of the normally closed third turnout position relay is connected to one end of the normally closed fourth turnout position relay, and the other end of the normally closed fourth turnout position relay is connected to the turnout switcher.

12. A turnout system, comprising:

a turnout and a switcher; and an interlocking protection device for turnout switching comprising:

a receiving module, configured to receive a turnout switching instruction;

a confirmation module, configured to receive a confirmation instruction;

a processing module, configured to determine a target turnout position according to the turnout switching instruction and output a driving confirmation signal according to the confirmation instructions; and a centralized control interlocking module, wherein the centralized control interlocking module comprises a confirmation unit and a position switch unit; under a centralized control mode, the confirmation unit carries out separate turnout locking according to the target turnout position and carries out locking confirmation according to the driving confirmation signal; after locking confirmation, the position switch unit closes target turnout position switches according to the target turnout position and opens other turnout position switches to output a target turnout switching control signal, wherein the confirmation unit further comprises:

locking switches, configured to be closed to carry out separate turnout locking when the target turnout position is received under the centralized control mode; and confirmation switches, configured to be closed to carry out locking confirmation when the driving confirmation signal is received under the centralized control mode.

13. The turnout system according to claim 12, wherein the locking switches comprise a first locking switch and a second locking switch, and the confirmation switches comprise a first confirmation switch and a second confirmation switch.

14. The turnout system according to claim 13, wherein, one end of the first locking switch is connected to one end of the first confirmation switch, the other end of the first locking switch is connected to a positive pole of a power supply, the other end of the first confirmation switch is connected to the position switch unit, one end of the second locking switch is connected to one end of the second confirmation switch, the other end of the second locking switch is connected to a negative pole of the power supply, and the other end of the second confirmation switch is connected to the position switch unit.

* * * * *